US006805267B2

(12) United States Patent
Bougamont

(10) Patent No.: US 6,805,267 B2
(45) Date of Patent: Oct. 19, 2004

(54) LIQUID PRODUCT DISPENSER

(75) Inventor: Jean-Louis Bougamont, Eu (FR)

(73) Assignee: Rexam Dispensing Systems, Le Treport (FR)

( * ) Notice: Subject to any disclaimer, the term of this patent is extended or adjusted under 35 U.S.C. 154(b) by 42 days.

(21) Appl. No.: 10/362,971

(22) PCT Filed: Sep. 7, 2001

(86) PCT No.: PCT/FR01/02781

§ 371 (c)(1),
(2), (4) Date: Mar. 6, 2003

(87) PCT Pub. No.: WO02/20171

PCT Pub. Date: Mar. 14, 2002

(65) Prior Publication Data

US 2004/0094578 A1 May 20, 2004

(30) Foreign Application Priority Data

Sep. 8, 2000 (FR) ..... 00 11470

(51) Int. Cl.[7] ..... B65D 37/00

(52) U.S. Cl. ..... 222/633; 222/207; 222/209; 222/321.7

(58) Field of Search ..... 222/632, 633, 222/207, 209, 321.7

(56) References Cited

U.S. PATENT DOCUMENTS 2,680,477 A * 6/1954 Schira, Jr. ..... 137/565.12
5,351,862 A * 10/1994 Weag ..... 222/145.3
5,462,208 A * 10/1995 Stahley et al. ..... 222/207
5,518,147 A * 5/1996 Peterson et al. ..... 222/153.07
5,664,703 A * 9/1997 Reifenberger et al. ..... 222/207

FOREIGN PATENT DOCUMENTS

WO WO 97/42124 * 11/1997

* cited by examiner

*Primary Examiner*—Joseph A. Kaufman
(74) *Attorney, Agent, or Firm*—Bacon & Thomas, PLLC

(57) ABSTRACT

The invention relates to a liquid dispenser of the type comprising a reservoir ($R_1$, $R_2$) provided at its top with an outflow orifice (V) which is closed off by an inlet valve (a) and which opens out into a metering chamber (10) of variable volume, which chamber communicates, via an outlet valve (e), with a discharge duct (c) provided in a dispensing head (T), the dispenser being characterized in that the metering chamber (10) is defined by a wall of a bellows (1) that is elastically deformable, at least in part.

5 Claims, 3 Drawing Sheets

LIQUID PRODUCT DISPENSER

The present invention relates to a liquid dispenser.

A large number of dispensers already exist that are of the type comprising a reservoir provided at its top with an outflow orifice which is closed off by an inlet valve and which opens out into a metering chamber of variable volume, which chamber communicates, via an outlet valve, with a discharge duct provided in a dispensing head.

Unfortunately, in such dispensers, the variations in the volume of the metering chamber and the compression of the liquid contained in the chamber that is necessary for said liquid to be discharged are obtained by means of a piston working axially in said chamber. The piston generally co-operates with resilient return means in the form of one or more metal helical springs.

Furthermore, the respective structures of each of the valves are, in particular, distinct because the inlet valve works without being stressed, unlike the outlet valve which is subjected to the high pressures prevailing in the chamber, and which thus operates in the manner of a pressure-relief valve.

In addition, in a very widespread and simple version, the inlet valve includes a metal ball in contact with the liquid.

As a result, conventional dispensers are composite because they have both metal parts and plastics parts, which poses manufacturing, assembly, and recycling problems, and can risk degrading the qualities of the liquid.

More precisely, the invention relates to a dispenser comprising a reservoir provided at its top with an outflow orifice which is situated at the end of a cylindrical rim, which is closed off by an inlet valve, and which opens out into a metering chamber of variable volume, which chamber is defined by the wall of a bellows that is elastically deformable at least in part, and communicates, via an outlet valve received in a bush extending said chamber, with a discharge duct provided in a dispensing head, the moving elements of the inlet valve and of the outlet valve being identical.

Document WO 97/42124 discloses a dispenser of that type, in which the moving elements of the inlet and outlet valves move in translation so as to dispense the substance contained in the reservoir, their strokes being limited by abutments. The mounting of the inlet valve and of the outlet valve therefore does not take account of the fact that the two valves are subjected to different stresses during operation of the dispenser.

The present invention seeks to improve that prior art by using a single component material that is easy to recycle.

The object is achieved as a result of the fact that the height of the rim which receives the inlet valve is less than the height of the bush which receives the outlet valve so that the moving element of the outlet valve is fitted under stress, whereas the moving element of the inlet valve has a small amount of freedom of movement in translation.

In a specific embodiment, each of said valves has an elastically deformable frustoconical closure cap extended by snap-fastening catches defining channels between them for passing the liquid.

In another variant, said reservoir is equipped with a collar whose sidewall guides the dispensing head and whose top edge retains said head.

Preferably, the bellows is fixed to the top portion of the reservoir.

According to other characteristics, said bellows is provided with a top shoulder against which stiffener fins carried by said head bear.

The dispenser of the invention has a structure that is very simple and ergonomic, and that is constituted of a small number of parts. In addition, it offers the industrial and economic advantage of being suitable for being made by molding (injection or compression molding) by using a single common plastics material for all of the component parts, which, in addition, makes it possible to preserve the qualities of the liquid.

The present invention will be better understood on reading the following description accompanied by the drawings, in which.

The liquid dispenser shown in the figures includes a reservoir in one or more pieces (R in FIG. 1, or $R_1$, $R_2$, $R_3$ in FIG. 3) provided at its top with an outflow orifice V closed off by an inlet valve a and opening out into a metering chamber 10 of variable volume. The metering chamber 10 further communicates, via an outlet valve e, with a discharge duct C provided inside a dispensing head T which, in this example forms a push button.

The chamber 10 is defined by the wall of a bellows 1 which is elastically deformable, at least in part.

The outflow orifice V of the reservoir R, $R_2$ is situated at the end of a cylindrical rim receiving the inlet valve a and projecting into the chamber 10.

The outlet valve e is received in a bush 12 which is integral with the bellows 1, which extends the metering chamber 10 upwards, and which connects coaxially to the discharge duct C in the head T.

The reservoir R, $R_2$ is provided with a collar r whose sidewall guides the head T as it is moving axially. The top edge of the collar is provided with a peripheral bead j which, by co-operating with a complementary rib n, retains the head T on the reservoir and locks together all of the components of the dispenser.

Figure 1:
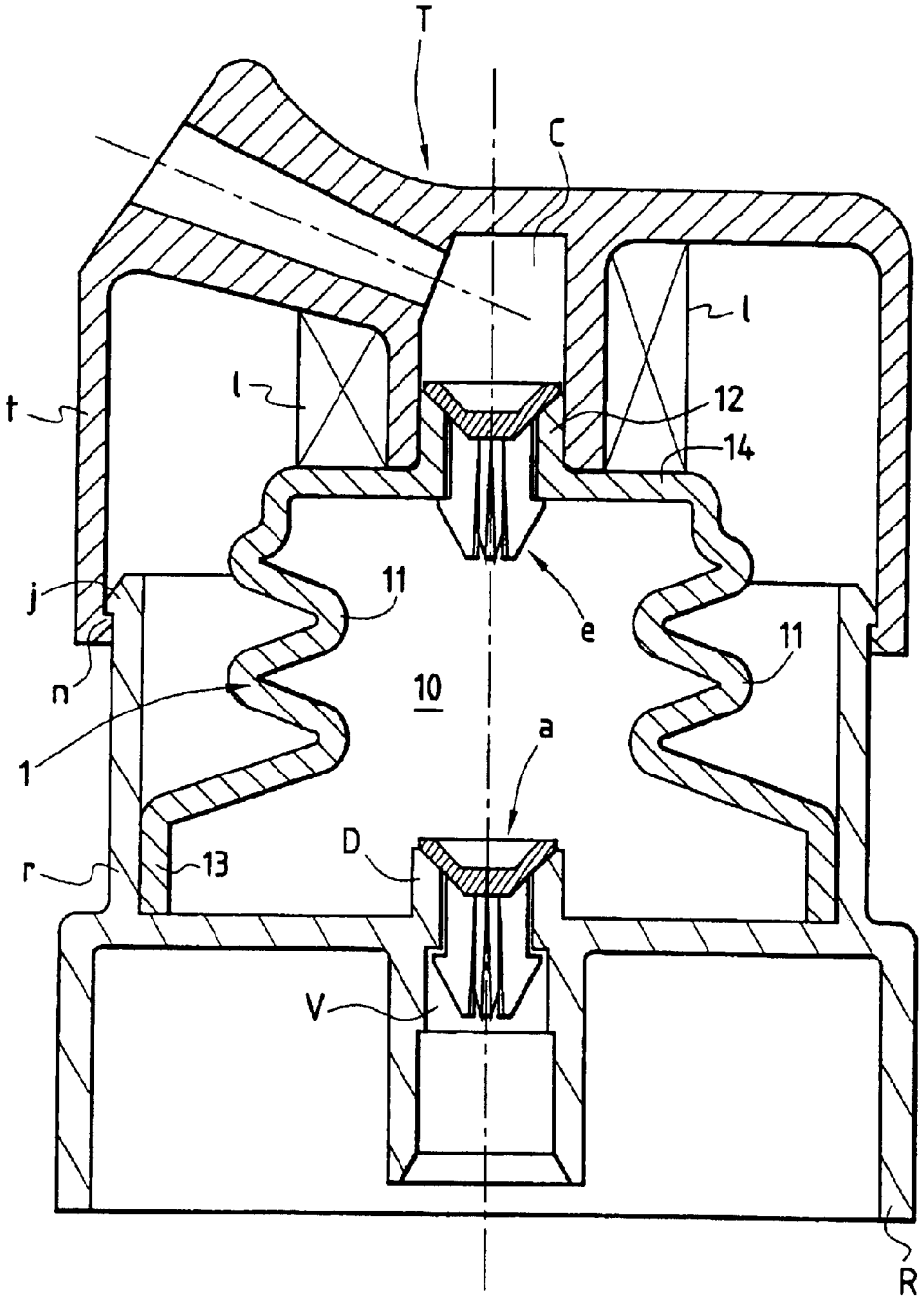
FIG. 1 is a fragmentary section view of an embodiment of the dispenser of the invention.
Figure 3:
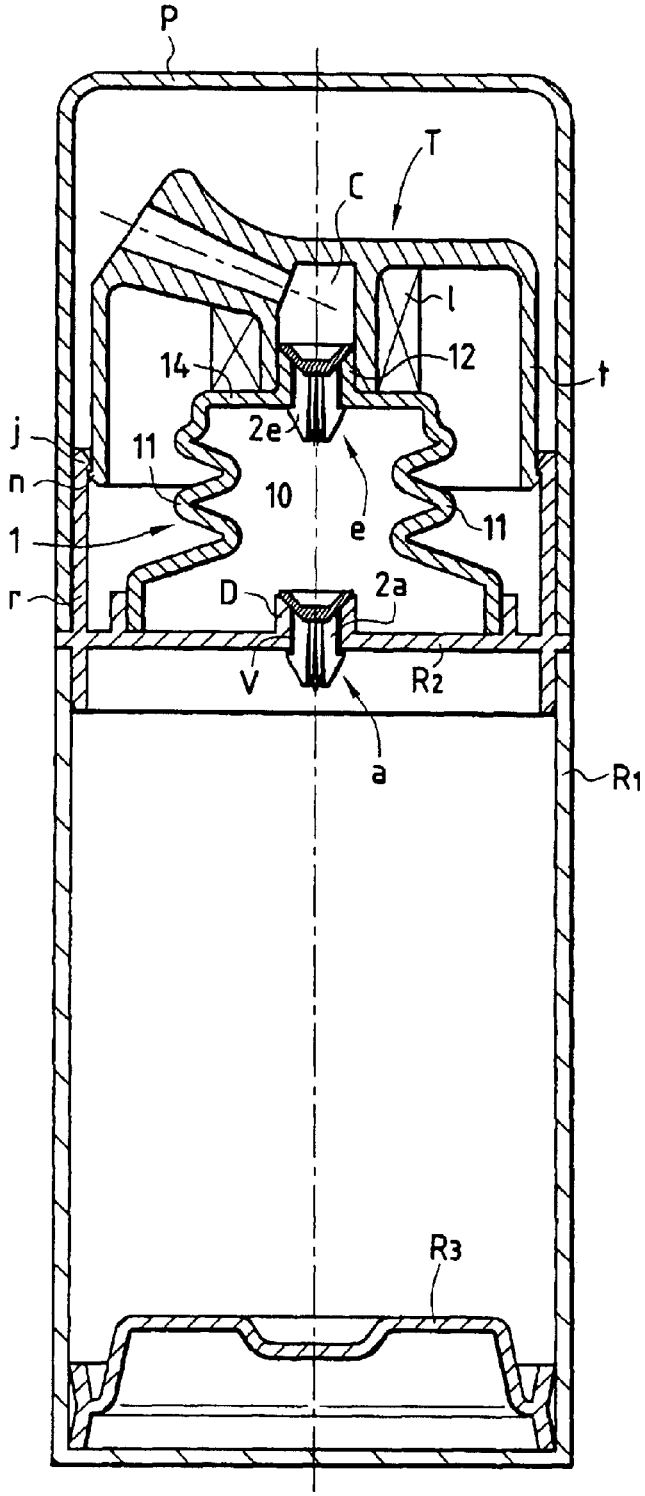
FIG. 3 is a section view of a variant embodiment of the dispenser of FIG. 1.

In the embodiment shown in FIG. 1, the head T fits onto the outside of the collar r whereas, in the variant shown in FIG. 3, it is the side skirt t of the head T which is engaged into the inside of the collar r.

In this variant, a cover P is fitted onto the outside of the collar r with a small amount of radial clamping.

The bellows 1 is fixed to the top portion of the reservoir and, more precisely, in the embodiment shown in FIG. 1, to the bottom portion of the collar r by means of the base 13. The pressure prevailing inside the chamber 10 results in radial thrust being applied to the base 13, thereby reinforcing the strength of the bellows 1.

The bellows 1 is preferably made with of a rigid plastics material such as polypropylene.

The bends 11 in the bellows 1 have capacity for elastic deformation and in particular flexibility that makes it possible for the bellows 1 to be compressed by bearing axially against the head T, and thus for the volume of the chamber 10 to be varied.

The bellows 1 is also provided with a top shoulder 14 against which stiffener fins I carried by the head T bear.

As shown in the figures, the moving elements 2*a*, 2*e* of the inlet valve a and of the outlet valve e are identical.

Figure 4:
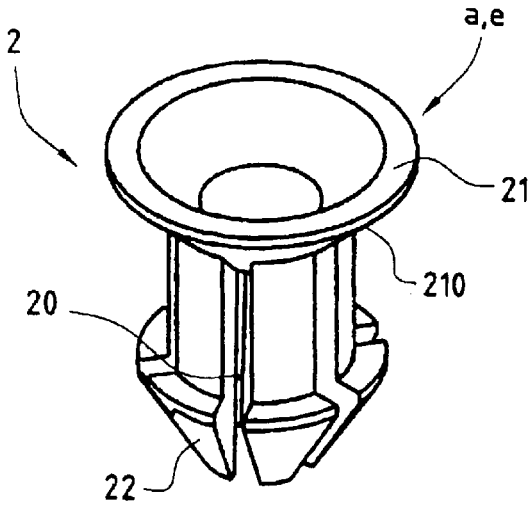
FIG. 4 shows a detail view in perspective of a moving valve element of the dispenser of FIG. 1.

Each of these elements has a structure of the type shown in FIG. 4.

Said structure has a frustoconical closure cap 21 which, at rest, bears against the top end of the rim D (FIG. 2*a*) or the top end of the bush 12 (FIG. 2B), the profile of each of said top ends being beveled. The cap 21 is extended downwards by snap-fastening catches 22 co-operating with a respective one of abutments 15, b provided respectively on the inside top wall of the bellows 1 and on the bottom portion of the rim D (see FIGS. 2A, 2B).

The catches 22 define channels 20 between them for passing the liquid.

Figure 2A:
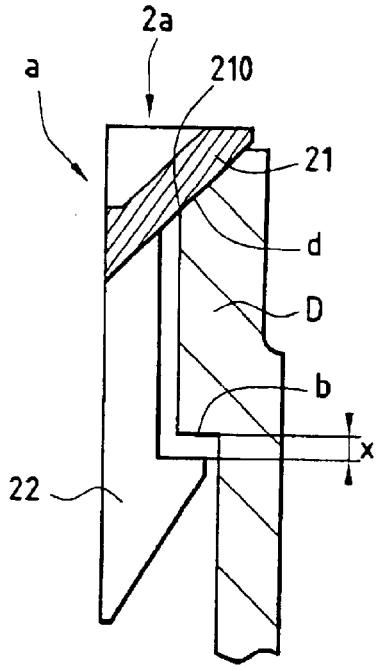
FIGS. 2A and 2B are section half-views respectively of the inlet valve and of the outlet valve of the dispenser of FIG. 1.

The height of the rim D is less than the height of the bush 12, so that the moving element 2*e* of the outlet valve e is fitted under stress, whereas the moving element 2*a* of the inlet valve has a small amount of freedom of movement in translation, of amplitude x (see FIG. 2A).

Figure 2B:
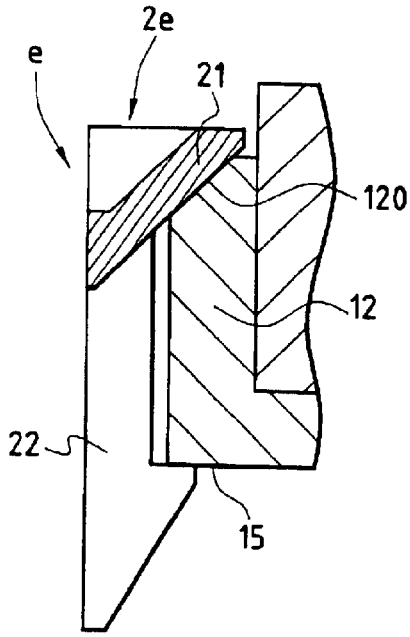

The element 2*a* rising by being sucked into the chamber 10 by a height x relative to its rest position makes it possible to form a gap through which liquid can enter the chamber 10 between the beveled inside edge d of the rim D that forms the valve seat, and the outside sidewall of the cap 21. In addition, the cap 21 is elastically deformable so as to make it possible, under the effect of the pressure generated in the chamber 10, for the liquid to exit via the outlet valve e between the outside wall 210 of the cap 21 that forms the valve member, and the beveled inside edge 120 of the bush 12 that forms the seat of the valve e (FIG. 2B).

The stiffness of the bush 12 is further reinforced by the presence of the discharge duct C which surrounds it coaxially.

What is claimed is:

1. A liquid dispenser of the type comprising a reservoir provided at its top with an outflow orifice which is situated at the end of a cylindrical rim, which is closed off by an inlet valve, and which opens out into a metering chamber of variable volume, which chamber is defined by the wall of a bellows that is elastically deformable at least in part, and communicates, via an outlet valve received in a bush extending said chamber, with a discharge duct provided in a dispensing head, the moving elements of the inlet valve and of the outlet valve being identical, wherein the height of the rim which receives the inlet valve is less than the height of the bush which receives the outlet valve so that the moving element of the outlet valve is fitted under stress, whereas the moving element of the inlet valve has a small amount of freedom of movement in translation.

2. The dispenser according to claim 1, wherein the moving element of each of the valves has an elastically deformable frustoconical closure cap extended by snap-fastening catches defining channels between them for passing the liquid.

3. The dispenser according to claim 1, wherein said reservoir is equipped with a collar whose sidewall guides the dispensing head and whose top edge retains said head.

4. The dispenser according to claim 1, wherein said bellows is fixed to the top portion of the reservoir.

5. The dispenser according to claim 1, wherein said bellows provided with a top shoulder against which stiffener fins carried by said head bear.

* * * * *